US012606947B2

(12) United States Patent
Xie et al.

(10) Patent No.: US 12,606,947 B2
(45) Date of Patent: Apr. 21, 2026

(54) STIRRING IMPELLER TYPE WASHING MACHINE

(71) Applicant: CHANGHONG MEILING CO., LTD., Hefei (CN)

(72) Inventors: Wenjie Xie, Hefei (CN); Kehui Huang, Hefei (CN); Shoutao Jia, Hefei (CN); Junjie Fang, Hefei (CN); Lujun Zhao, Hefei (CN); Xiaolong Ma, Hefei (CN)

(73) Assignee: CHANGHONG MEILING CO., LTD., Hefei (CN)

( * ) Notice: Subject to any disclaimer, the term of this patent is extended or adjusted under 35 U.S.C. 154(b) by 326 days.

(21) Appl. No.: 18/233,340

(22) Filed: Aug. 14, 2023

(65) Prior Publication Data

US 2024/0218582 A1 Jul. 4, 2024

(30) Foreign Application Priority Data

Jan. 4, 2023 (CN) ..... 202310015744.X

(51) Int. Cl.
*D06F 34/30* (2020.01)
*D06F 23/04* (2006.01)
(Continued)

(52) U.S. Cl.
CPC ..... *D06F 34/30* (2020.02); *D06F 23/04* (2013.01); *D06F 34/08* (2020.02); *D06F 34/22* (2020.02);
(Continued)

(58) Field of Classification Search
CPC ..... D06F 34/30; D06F 34/22; D06F 34/34; D06F 34/08; D06F 23/04; D06F 37/12;
(Continued)

(56) References Cited

U.S. PATENT DOCUMENTS

2006/0164397 A1* 7/2006 Bruntz ..... D06F 34/30 345/172

FOREIGN PATENT DOCUMENTS

CN 206591319 U 10/2017
JP H0647186 A 2/1994
(Continued)

OTHER PUBLICATIONS

WO2018236155A1—machine translation (Year: 2018).*
(Continued)

*Primary Examiner* — Tinsae B Ayalew
(74) *Attorney, Agent, or Firm* — Laine IP Oy

(57) ABSTRACT

This application provides a stirring impeller type washing machine including a washing machine body, a washing assembly, and a water level assembly. The washing assembly includes a mode switch and a program controller connected to each other, the program controller has at least two switching positions, each corresponding to a working mode, different rotation orientations of the mode switch correspond to different working modes of the stirring impeller type washing machine. The water level assembly includes a water level sensor, an encoder connected to the water level sensor, and a water level switch and a water injection controller connected to the encoder, wherein a preset water level is adjustable through different rotation orientations of the water level switch. With the stirring impeller type washing machine, the operation and the control become more convenient and sensitive, and the washing degree is higher.

7 Claims, 5 Drawing Sheets

(51) Int. Cl.

| | |
|---|---|
| ***D06F 34/08*** | (2020.01) |
| ***D06F 34/22*** | (2020.01) |
| ***D06F 34/34*** | (2020.01) |
| ***D06F 37/12*** | (2006.01) |
| ***D06F 37/30*** | (2020.01) |
| ***D06F 39/08*** | (2006.01) |
| ***D06F 39/14*** | (2006.01) |
| *D06F 103/18* | (2020.01) |
| *D06F 105/02* | (2020.01) |
| *D06F 105/50* | (2020.01) |

(52) U.S. Cl.
CPC ..... *D06F 34/34* (2020.02); *D06F 37/12* (2013.01); *D06F 37/304* (2013.01); *D06F 39/085* (2013.01); *D06F 39/087* (2013.01); *D06F 39/088* (2013.01); *D06F 39/14* (2013.01); *D06F 2103/18* (2020.02); *D06F 2105/02* (2020.02); *D06F 2105/50* (2020.02)

(58) Field of Classification Search
CPC .... D06F 37/304; D06F 39/085; D06F 39/087; D06F 39/088; D06F 39/14; D06F 2105/50; D06F 2103/18; D06F 2105/02
USPC ..... 68/12.05
See application file for complete search history.

(56) References Cited

FOREIGN PATENT DOCUMENTS

| | | | | | |
|---|---|---|---|---|---|
| JP | H10295979 | A | | 11/1998 | |
| JP | 2000176194 | A | | 6/2000 | |
| KR | 100187332 | B1 | * | 5/1999 | ..... D06F 37/12 |
| KR | 19990076393 | A | | 10/1999 | |
| KR | 20070066603 | A | * | 6/2007 | ..... D06F 37/42 |
| KR | 20200001020 | A | | 1/2020 | |
| WO | WO-2018236155 | A1 | * | 12/2018 | ..... H02J 50/10 |
| WO | WO2021155779 | A1 | | 8/2021 | |

OTHER PUBLICATIONS

KR20070066603A—machine translation (Year: 2007).*
KR100187332B1—machine translation (Year: 1999).*
Office action in corresponding CN application 202310015744.X dated Aug. 26, 2025.

* cited by examiner

STIRRING IMPELLER TYPE WASHING MACHINE

FIELD OF THE INVENTION

This application relates to the technical field of washing machine, and in particular, to a stirring impeller type washing machine.

BACKGROUND OF THE INVENTION

Washing machines are common household appliances. Washing machines, that are currently commercially available, mainly include traditional mechanical impeller washing machines and modern electronic impeller washing machines. Washing functions of the traditional mechanical impeller washing machine are mainly set by a user manually turning a switch, which has the characteristics of convenient operation and simple and reliable structure. In contrast, various functions of many electronic impeller washing machines currently commercially available are mainly set through computer program control, which is more suitable to young people's needs for modernization.

However, electronic impeller washing machine often have to face one problem during its use: when older users or young users have little experience in using the electronic impeller washing machine or are not familiar with the relevant electronic operations, they may not be able to use the electronic impeller washing machine effectively, or they may not be able to choose the most suitable washing function. In this case, these users tend to prefer to use the traditional mechanical impeller washing machines.

However, the mechanical impeller washing machines currently available on the market are all twin-tub washing machines, which has to face the problem that dehydration and washing need to be carried out separately, although it is easy to operate when setting the functions.

SUMMARY OF THE INVENTION

In order to solve the problems that the existing automatic impeller washing machines are all electronically controlled and one has to use buttons to select the programs, which is cumbersome for some users, and the operation is not clear and may even lead to wrong use, it is provided according to the present application a stirring impeller type washing machine, including:

a washing machine body having a cabinet, a cover plate mounted on the cabinet, and a washing tub arranged in the cabinet, wherein a part of the washing tub can be driven by a motor to rotate;

a washing assembly mounted on the cabinet or the cover plate, wherein the washing assembly includes a mode switch and a program controller which are connected to each other, the program controller has at least two switching positions, each of which corresponds to a working mode, and different rotation orientations of the mode switch correspond to different working modes of the stirring impeller type washing machine; and a water level assembly mounted on the cabinet or the cover plate, wherein the water level assembly includes a water level switch, a water injection controller, an encoder and a water level sensor, both the water level switch and the water injection controller are connected to the encoder, the encoder is connected to the water level sensor, the water level sensor faces towards an inner region of the washing tub; the encoder can directly or indirectly control the water injection controller to stop water injection after the water level sensor detects that the water level in the washing tub reaches a preset water level, wherein the water level switch allows to adjust the preset water level through different rotation orientations.

In some embodiments, the cover plate includes:

a face frame fixedly connected with the cabinet and covering an upper opening of the cabinet, wherein the face frame is provided with an entrance;

a control mounting plate fixedly connected with the face frame and arranged at one side of the entrance, wherein both the mode switch and the water level switch are mounted on the control mounting plate; and a door cover movably connected with the face frame, having a first position for closing the entrance and a second position for opening the entrance, wherein the door cover can be switched between the first position and the second position.

In some embodiments, the control mounting plate is capable of cooperating with the face frame to form an accommodation chamber, and the program controller and the encoder are both mounted within the accommodation chamber; and a first bracket and a second bracket are provided on an inner wall of the accommodation chamber, wherein the program controller is mounted on the first bracket, the encoder is mounted on the second bracket, a mode button is provided on and passed through the control mounting plate and is connected to the program controller, and a water level button is provided on and passed through the control mounting plate and is connected to the encoder.

In some embodiments, at least one of the water injection controller and the encoder is connected to the program controller, and after the water level in the washing tub reaches a preset water level, at least one of the water injection controller and the encoder activates the program controller to drive the stirring impeller type washing machine to work.

In some embodiments, the washing tub includes an inner tub and an outer tub, the inner tub and the outer tub are movably connected, the inner tub is rotatable within the outer tub, and the outer tub is suspended in the cabinet through at least three suspension rods.

In some embodiments, a connecting pipe and a tractor are provided at the bottom of the outer tub, the connecting pipe is connected with a drainage pump which is disposed on the cabinet, and the tractor is respectively connected to the drainage pump, the washing assembly and the water level assembly; and an outer ring is provided at the top of the outer tub and at least partially covers the region on top of the inner tub.

In some embodiments, a control circuit board and a capacitor are arranged inside the cabinet, the control circuit board is connected to the capacitor, and the control circuit board is electrically connected to both the washing assembly and the water level assembly to control the works of the washing assembly and the water level assembly.

In some embodiments, the washing machine body further includes:

a driving member mounted in the cabinet, under the outer tub;

a transmission assembly having an input end and an output end, the input end being connected with the driving member; and a clutch connected with the inner tub, and capable of driving the inner tub to rotate relative to the outer tub, wherein one side of the clutch away from the inner tub is connected with the output end;

wherein, the clutch has a first connecting member and a second connecting member that can be connected to or separated from each other, and the clutch has a connected state in which the first connecting member and the second connecting member are connected to form one piece and the clutch can transmit the torque of the output end to the inner tub, and a separated state in which the first connecting member and the second connecting member are separated from each other and are movably connected, the torque of the output end can only be transmitted to the first connecting member or the second connecting member, and the inner tub is stationary.

In some embodiments, the washing machine body further comprises a base fixedly connected at the bottom of the cabinet.

In some embodiments, a stirring seat is disposed inside the inner tub, and the outer peripheral surface of the stirring seat is in the shape of a spiral rod.

The beneficial effects of the present application are as follows: it can combine the fully automatic characteristics of the impeller washing machine with the convenience of mechanical operation, in which the washing mode of the washing machine is controlled by the washing assembly, and the water level is controlled by the water level assembly. Specifically, the water level can be adjusted through the water level switch, and with the cooperation of the encoder and the water level sensor, the water level can be controlled more accurately. Therefore, the program controller can better control the washing program and time, which greatly improves the accuracy of water volume and the operability, and makes the operation clear to the use at a glance. The above-mentioned configurations not only solve the semi-automatic operation of the twin tubs, but also are simple and clear in the program selection. The design of a stirring seat of such stirring type washing machine can make the clothes less entangled and have a higher degree of cleanliness through certain control.

DETAILED DESCRIPTION OF THE EMBODIMENTS

Figure 1:
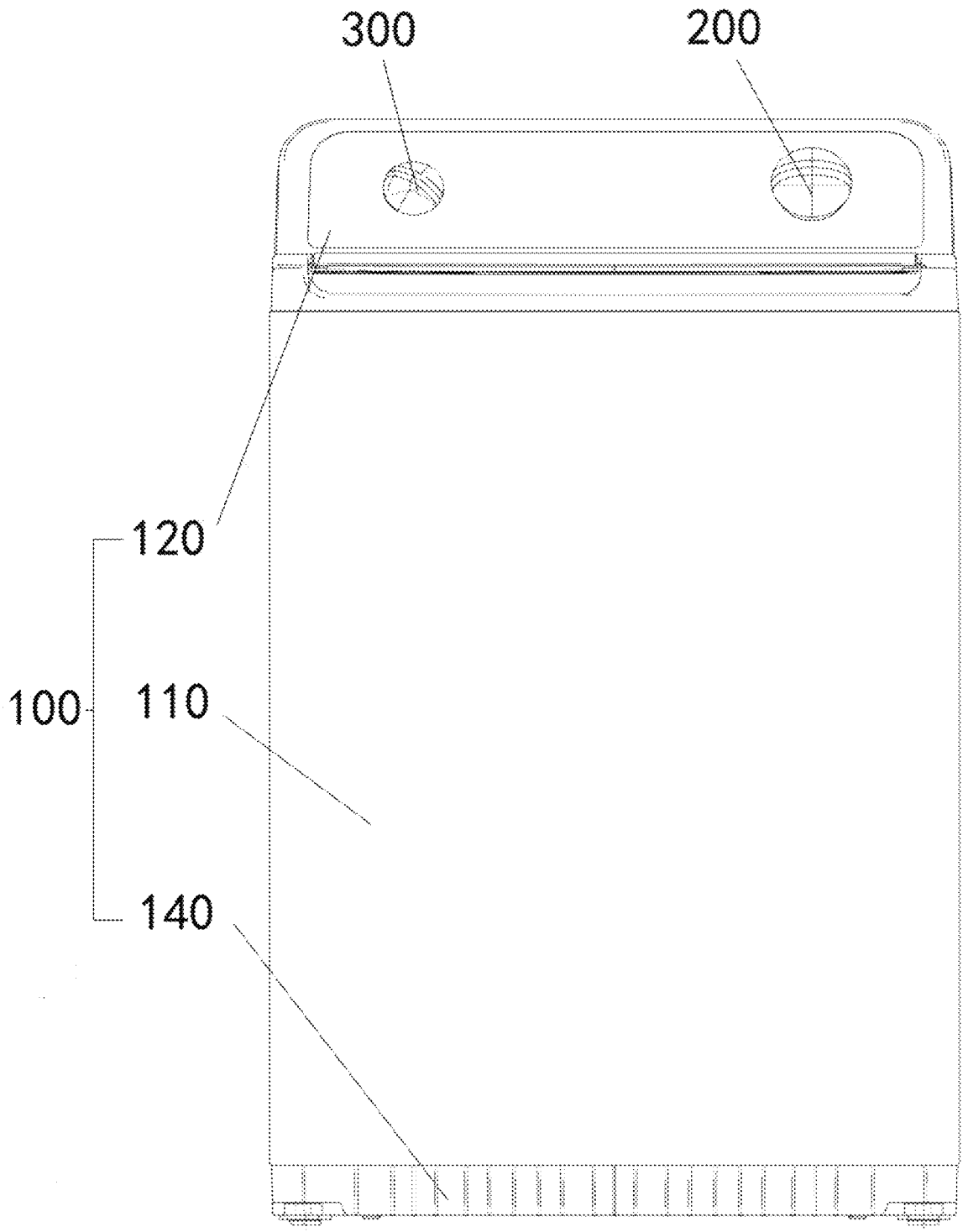
FIG. 1 shows a schematic diagram of a side structure of a stirring impeller type washing machine provided according to an embodiment of the present application.
Figure 2:
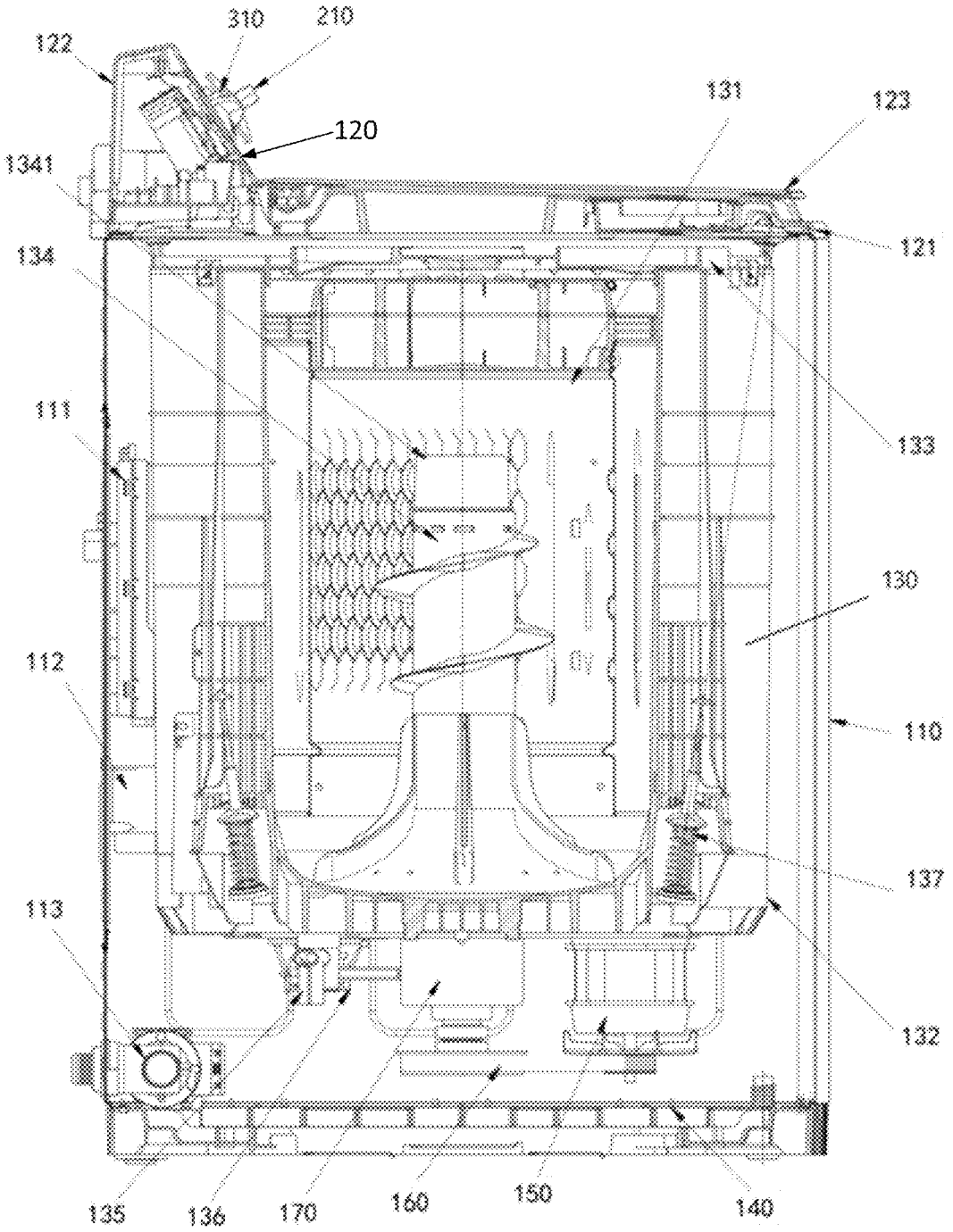
FIG. 2 shows a schematic cross-sectional structure diagram of a stirring impeller type washing machine according to the present application.
Figure 3:
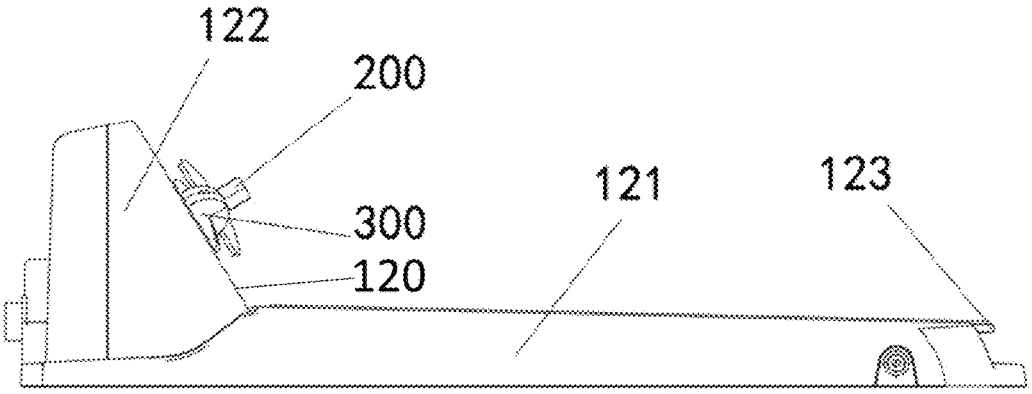
FIG. 3 shows a schematic diagram of a side structure of a cover plate of a stirring impeller type washing machine provided according to an embodiment of the present application.
Figure 4:
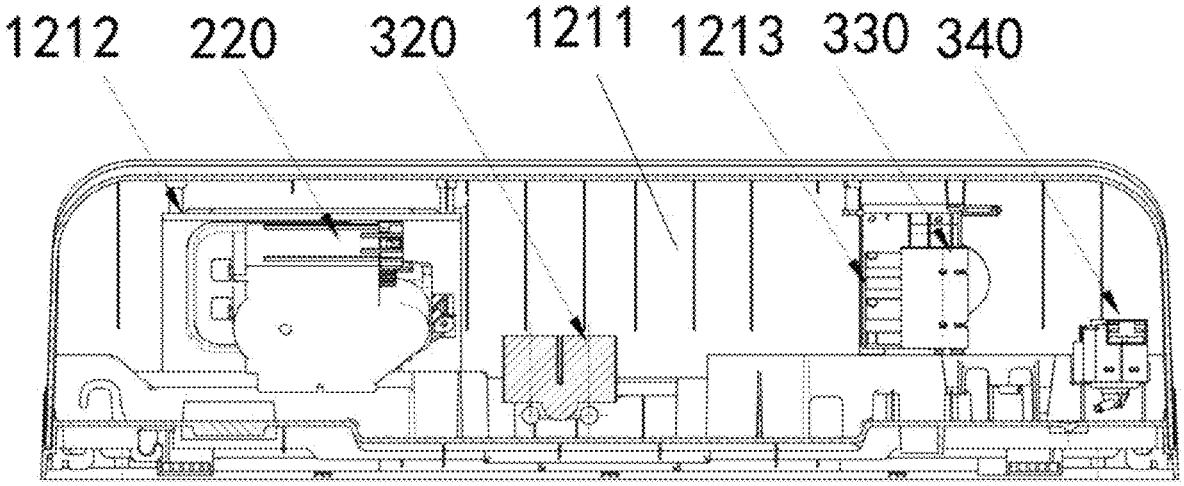
FIG. 4 shows a schematic cross-sectional structure diagram of a cover plate of a stirring impeller type washing machine according to the present application.
Figure 5:
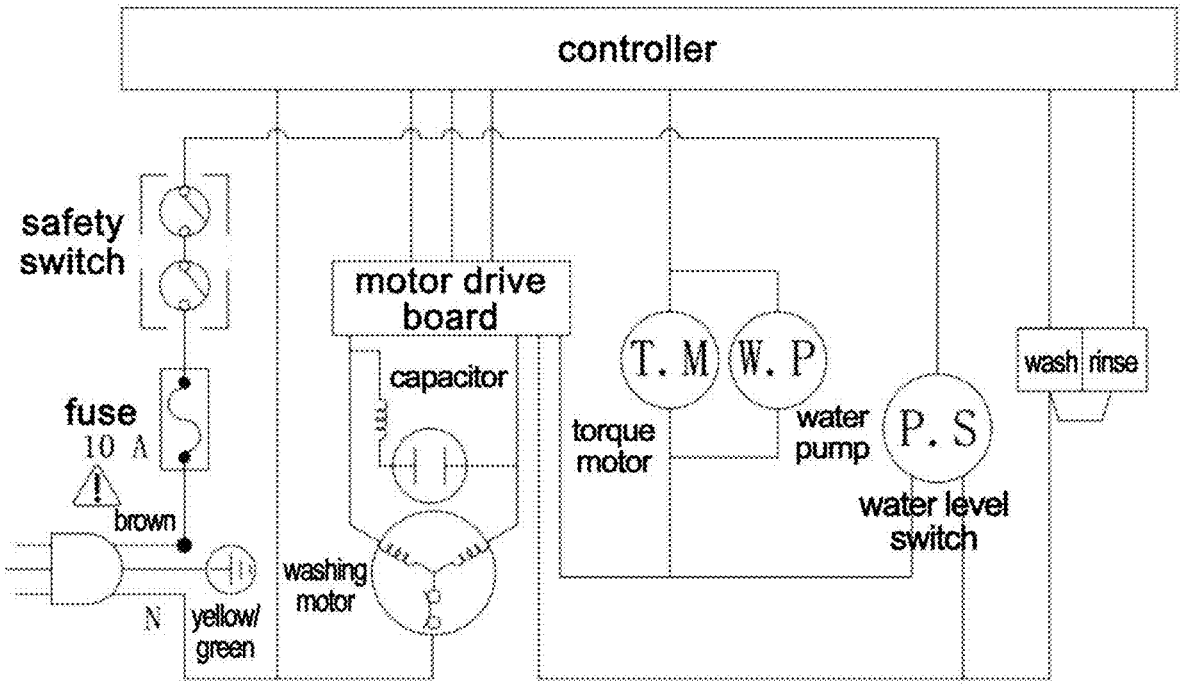
FIG. 5 shows a schematic diagram of the working principle of a stirring impeller type washing machine provided according to an embodiment of the present application.

In the related technical fields, the washing machine, as an important and practical household appliance, has become an indispensable daily appliance. Wherein, traditional mechanical impeller washing machine is more convenient to operate and has a simpler and more reliable structure in comparison with current electronic impeller washing machine. The automatic impeller washing machines currently available on the market are generally controlled via computer programs, there are also separate semi-automatic twin-tub washing machines, but they are difficult to operate for some people. Besides, the stirring type washing machines available on the market are merely provided therein with a stirring seat.

At present, the mechanical washing machine available on the market is only a twin-tub washing machine, and there is no automatic mechanical stirring impeller type washing machine on the market. The twin-tub washing machine is easy to operate, but the dehydration and washing thereof need to be carried out separately; while the automatic impeller washing machine is electronically controlled, and one needs to use the buttons to select programs, however, for some users, it is cumbersome, the operation is not clear, and may even leads to improper operation.

Therefore, in view of the above problems, the present application proposes a stirring impeller type washing machine.

A stirring impeller type washing machine provided by the present application and its working principle will be described below with reference to FIGS. 1-5.

As shown in FIGS. 1 to 5, a stirring impeller type washing machine includes a washing machine body 100, a washing assembly 200, and a water level assembly 300. The washing machine body 100 includes a cabinet 110, a cover plate 120 mounted on the cabinet 110, and a washing tub 130 disposed in the cabinet 110, wherein a part of the washing tub 130 is rotatable under the drive of a motor.

The washing assembly 200 is mounted on the cabinet 110 or the cover plate 120. The washing assembly 200 includes a mode switch 210 and a program controller 220 which are connected to each other. The program controller 220 has at least two switching positions, each of which corresponds to a working mode, and different rotation orientations of the mode switch 210 correspond to different working modes of the stirring impeller type washing machine.

The water level assembly 300 is mounted on the cabinet 110 or the cover plate 120. The water level assembly 300 includes a water level switch 310, a water injection controller 320, an encoder 330 and a water level sensor 340. Both the water level switch 310 and the water injection controller 320 are connected to the encoder 330, the encoder 330 is connected to the water level sensor 340, and the water level sensor 340 faces towards the inner region of the washing tub 130. The encoder 330 is capable of directly or indirectly controlling the water injection controller 320 to stop water injection after the water level sensor 340 detects that the water level in the washing tub 130 reaches a preset water level, wherein the water level switch 310 can adjust the preset water level through different rotation orientations.

According to the above embodiments of the present application, the above-mentioned configurations can combine the fully automatic characteristics of the impeller washing machine with the convenience of mechanical operation, that is to say, the washing mode of the washing machine is controlled by the washing assembly 200, and the water level is controlled by the water level assembly 300. Specifically, the water level can be adjusted through the water level switch 310, and with the cooperation of the encoder 330 and the water level sensor 340, the water level can be controlled more accurately, and the program controller 220 can better control the washing program and time, which greatly improves the operability and the accuracy of water volume, and makes the operation clear at a glance to the user. The above-mentioned configurations not only solve the semi-automatic operation problem of the double tubs, but also are simple and clear in the program selection. The design of a stirring seat 134 of this stirring washing machine can make the clothes less entangled and have a higher degree of cleanliness through certain control(s). The embodiments of the present application have the beneficial effects of making the operation of the washing machine more convenient, the water level control more sensitive, and the cleanliness degree higher.

It should be noted that the program controller 220 may be set with three gears, that is to say, the program controller 220 is configured with three programs, each program may be subdivided into more segments, and the working mode, i.e., the washing mode, may be changed via the mode switch 210. The change of the water level gear, that is, the change of the stirring frequency, may be changed according to the encoder 330. The encoder 330 may be set with seven gears, wherein gears 1-4 have fast stirring frequencies, and gears 5-7 have slow stirring frequencies. The water level may be adjusted manually according to the amount of clothes. The program controller 220 may be a mechanical program controller 220 or other types of program controller 220.

Further, the washing water levels indicated on the water level switch 310 are MIN, MID, and MAX clockwise from left to right, and a corresponding water level may be selected by turning the switch to the corresponding gear. Program selection: there are 3 programs on a control panel for selection, which are HEAVY, NORMAL, and GENTLE. Each program consists of three segments: wash, rinse, and spin, and in different programs, the repetition times of the "rinse" and the "spin" are different. With the switch being turned to a functional position of a corresponding program, a corresponding function corresponding to the program is selected. For example, if the switch is turned to the area of the "wash" of the HEAVY program, the washing program of the HEAVY program is selected. After the program selection is completed, the program is started when the switch is pulled up, and is paused when the switch is pressed.

As shown in FIGS. 1 to 5, in some embodiments, the cover plate 120 includes a face frame 121, a control mounting plate 122 and a door cover 123. The face frame 121 is fixedly connected with the cabinet 110 and covers an upper opening of the cabinet 110, and an entrance is provided in the face frame 121. The control mounting plate 122 is fixedly connected with the face frame 121 and is arranged at one side of the entrance, wherein both the mode switch 210 and the water level switch 310 are mounted on the control mounting plate 122. The door cover 123 is movably connected with the face frame 121, has a first position for closing the entrance and a second position for opening the entrance, and may switch between the first position and the second position.

Based on the above embodiment of the present application, the face frame 121 is the main structure of the cover plate 120, and both the control mounting plate 122 and the door cover 123 are mounted on the face frame 121. The control mounting plate 122 is configured to mount partial structures of the washing assembly 200 and the water level assembly 300. The door cover 123 may be opened and closed manually or electrically, that is, it may be switched between the first position and the second position manually, or a corresponding transmission mechanism may be additionally provided so as to switch its opening and closing states via remote control or switch control.

In some embodiments, the control mounting plate 122 can cooperate with the face frame 121 to form an accommodation chamber 1211, in which the program controller 220 and the encoder 330 are accommodated.

A first bracket 1212 and a second bracket 1213 are disposed on an inner wall of the accommodation chamber 1211. The program controller 220 is mounted on the first bracket 1212, and the encoder 330 is mounted on the second bracket 1213. The mode button is provided on and passed through the control mounting plate 122 and is connected to the program controller 220, and the water level button is provided on and passed through the control mounting plate 122 and is connected to the encoder 330.

Figure 6:
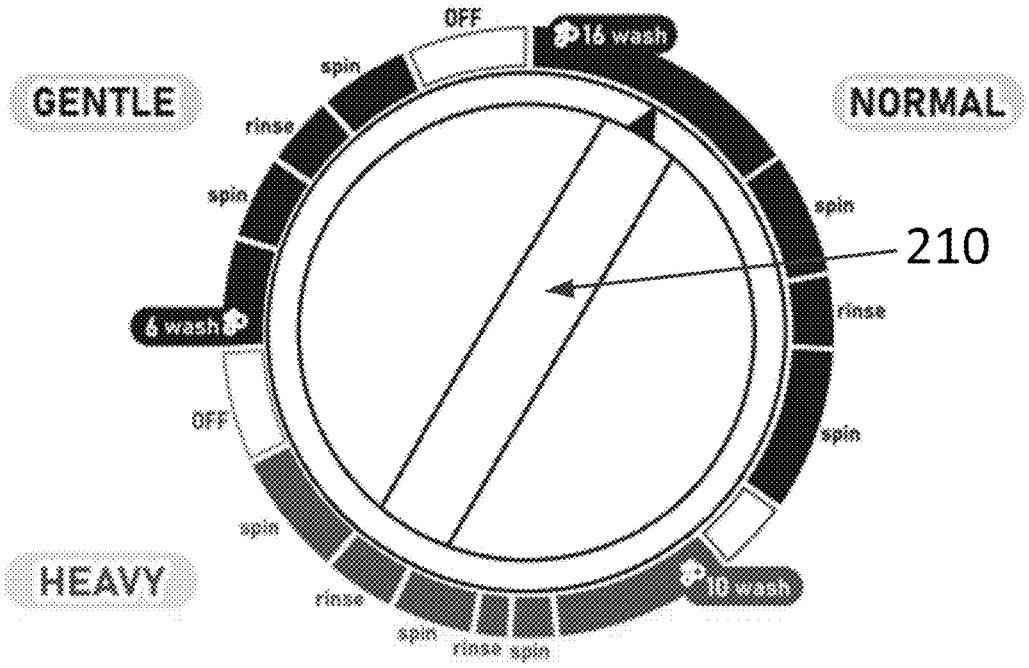
FIG. 6 shows a schematic diagram of a mode button according to an embodiment of the present application.

Specifically, the relationship between the mode button and the program controller 220 may be illustrated by FIG. 6. The program controller 220 may be configured with multiple pins (or multiple terminals), and these pins are respectively configured to indicate a specific control program and correspond to the individual positions on the dial of the mode button. For example, there are multiple different areas on the dial of the mode button in FIG. 6, wherein each area corresponds to a different program: HEAVY, NORMAL, GENTLE, and each program has three gears: wash, rinse and spin. In this way, it will be possible switch to multiple gears identifying different programs within the rotation range of the mode button. For example, a current gear is NORMAL-wash gear, which means the pin corresponding to the NORMAL-wash gear is electrically connected to the program controller, while the remaining gears are neutral, and in this case, the program controller 220 may determine, according to the connection situation, that a start operation of the function program corresponding to the current pin is to be performed.

Figure 7:
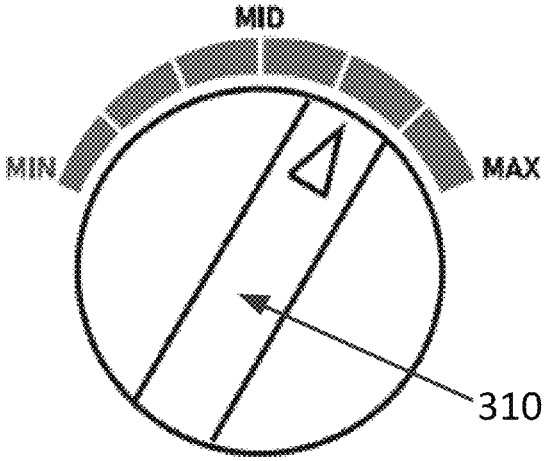
FIG. 7 shows a schematic diagram of a water level button according to an embodiment of the present application.

Similarly, the relationship between the water level button and the encoder 330 may be illustrated by FIG. 7. The encoder 330 may also be configured with multiple pins (or multiple terminals), and these pins are respectively configured to indicate a specific preset water level. For example, there are 3 different areas on the dial of the water level button in FIG. 7, and each area corresponds to a different preset water level: MIN, MID, MAX. In this way, within the rotation range of the water level button, it will be possible to switch to 3 gears that identify different preset water levels. For example, the current gear is MID gear, which means that the pin corresponding to the MID gear is electrically connected to the encoder, and the remaining gears are neutral. At this time, the encoder may determine, according to the connection situation, that the setting operation of the preset water level corresponding to the current pin is about to be performed.

Based on the above embodiments of the present application, the accommodation chamber 1211 may accommodate the program controller 220 and the encoder 330, and with the arrangement of the first bracket 1212 and the second bracket 1213, the program controller 220 and the encoder 330 may be mounted more stable and reliable. Moreover, the program controller 220 and the encoder 330 may be protected by the control mounting plate 122 itself.

In some embodiments, at least one of the water injection controller 320 and the encoder 330 is connected with the program controller 220, and after the water level in the washing tub 130 reaches a preset water level, at least one of the water injection controller 320 and the encoder 330 activates the program controller 220 to drive the stirring impeller type washing machine to work.

Based on the above embodiments of the present application, the above-mentioned configuration may make the washing process smoother, ensure that only the washing process is to be performed after the water level reaches the preset water level, and improve the washing efficiency.

It should be noted that the water injection controller 320 may be a water injection pump or a water injection valve, and water injection may be performed or stopped by activation or deactivation of the water injection pump or the water injection valve. At the same time, the following drainage pump 113 may be combined to discharge excess water, so as to discharge part of the water in time in case that the water level in the washing tub 130 is higher than the preset water level. Meanwhile, a threshold may be set, for example, if the water level is higher than 0.5 L, it is no need to perform the discharge process, and may directly perform the washing process. When the water level in the washing tub 130 is much lower than the preset water level, the water injection pump may be controlled to inject water so as to ensure there are sufficient water.

As shown in FIGS. 1 to 5, in some embodiments, the washing tub 130 includes an inner tub 131 and an outer tub 132, wherein the inner tub 131 and the outer tub 132 are movably connected, the inner tub 131 is rotatable within the outer tub 132, and the outer tub 132 is suspended within the cabinet 110 through at least three suspension rods 137.

Based on the above embodiments of the present application, with the above-mentioned configuration, the relative rotation between the inner tub 131 and the outer tub 132 drive the clothes in the washing tub 130 to move, thereby ensuring the washing effect. The outer tub 132 suspended within the cabinet 110 can improve the connection stability between the outer tub 132 and the cabinet 110. Four suspension rods 137 may be provided as required to further improve the connection stability.

In some embodiments, a connecting pipe 135 and a tractor 136 are provided at the bottom of the outer tub 132, wherein the connecting pipe 135 is connected with the drainage pump 113 arranged on the cabinet 110, and the tractor 136 is respectively connected to the drainage pump 113, the washing assembly 200 and the water level assembly 300. An outer ring 133 is provided at the top portion of the outer tub 132, and the outer ring 133 at least partially covers the upper region of the inner tub 131.

Based on the above embodiments of the present application, the connecting pipe 135 may be connected with the drainage pump 113 to improve the drainage efficiency of the washing machine (referring to a stirring impeller type washing machine, similar reference exists in the other parts of the description). The outer ring 133 may cover the upper region of the inner tub 131 so as to avoid direct contact of human hands with the rotating inner tub 131, thereby improving the safety of the washing machine.

It should be noted that the tractor 136 has three functions of traction, holding, and releasing. The working principle of the cooperation between the tractor 136 and each program of the washing machine may be as follows: when a control circuit board issues a draining (or drying) command, a traction motor and an anti-reverse electromagnet in the tractor 136 are simultaneously energized to work, wherein the motor draws a steel wire (or rack) into the tractor 136 through a gear set, and the steel wire thus pulls the drain valve to drain water, and, with a mechanical linkage mechanism, makes the ratchet and the pawl of a clutch 170, which having both washing and drying functions, be separated (at the same time, a locker of the spin-drying tub is released), to prepare for the synchronous rotation of the impeller and the inner bucket 131 during the next drying process (a square wire spring in the ratchet tightly hugs the impeller shaft and the shaft of the inner tub 131 together); the anti-reverse electromagnet is energized to attract its linkage mechanism to bounce up, so as to ensure that the motor rotates in one direction to draw the steel wire, and when these have been properly performed, the motor is deenergized via a limit switch in the tractor 136, and thus the rotation of the motor is stopped, while the electromagnet is continuously energized, attracting its linkage mechanism to tightly lock the steel wire so as to overcome the reverse tension of the return spring of the drain valve, maintaining the original working state. When the draining (drying) program is completed, a command from the control circuit board 111 causes the power off of the tractor 136, and the anti-reversal mechanism inside it is released, and the traction steel wire is pulled out under the action of the return spring of the drain valve, so that the drain valve is closed, and the linkage mechanism synchronously allows the pawl to mesh with the ratchet of the clutch 170 (the impeller shaft is disengaged from the shaft of the spin-drying tub, so that the clutch 170 returns to the washing state).

In some embodiments, a control circuit board 111 and a capacitor 112 are arranged inside the cabinet 110, wherein the control circuit board 111 is connected to the capacitor 112, and the control circuit board 111 is electrically connected to both the washing assembly 200 and the water level assembly 300 to control the washing assembly 200 and the water level assembly 300 to work.

Based on the above embodiments of the present application, the control circuit board 111 is provided thereon with a controller, that is, a processor, which may centrally control the operation of the entire washing machine, and the various components of the washing machine are electrically connected onto the control circuit board 111 directly or indirectly. The work of the washing assembly 200 and the water level assembly 300 may be controlled by the control circuit board 111, and the control of the control circuit board 111 may be assisted by the mode switch 210 and the water level switch 310.

It should be noted that the capacitor 112 may be connected to a driving member 150 described below, which may reduce the difficulty of activating the driving member 150, and the driving member 150 may be a motor.

In some embodiments, the washing machine body 100 further includes a driving member 150, a transmission assembly 160, and a clutch 170. The driving member 150 is mounted in the cabinet 110, under the outer tub 132; the transmission assembly 160 has an input end connected with the driving member 150 and an output end; the clutch 170 is connected with the inner tub 131, and can drive the inner tub 131 to rotate relative to the outer tub 132, and one side of the clutch 170 away from the inner tub 131 is connected with the output end.

The clutch 170 has a first connecting member and a second connecting member that can be connected or separated, and the clutch 170 has a connected state and a separated state. In the connected state, the first connecting member and the second connecting member are connected as a whole, and the clutch 170 can transmit the torque of the output end to the inner tub 131; in the separated state, the first connecting member and the second connecting member are separated from each other and are movably connected, the torque of the output end can only be transmitted to the first connecting member or the second connecting member, and the inner tub 131 is stationary.

Based on the above embodiments of the present application, the driving member 150 can provide power for the rotation of the inner tub 131 in the washing machine, the transmission assembly 160 can transmit the power of the driving member 150 to the inner tub 131, and the clutch 170 may selectively transmit the torque of the output end as required, thereby providing support for the various modes of the washing machine. Specifically, the driving member 150 may be a torque motor. The transmission assembly 160 may be a belt transmission assembly, a gear transmission assembly, a rack and pinion transmission assembly, a worm gear transmission assembly, and the like.

In some embodiments, the washing machine body 100 further includes a base 140 fixedly connected at the bottom of the cabinet 110.

Based on the above embodiments of the present application, the base 140 may better support the washing machine body 100, and the whole washing machine can be placed more stably through the base 140. An adjustment mechanism may be provided on the base 140 as required, and the adjustment structure may adjust the support height of the base 140. When the ground is uneven, the washing machine may be leveled through the adjustment mechanism. Further, structures such as a rubber pad an anti-skid pad and the like may be provided under the base 140. The base 140 may consist of four legs.

In some embodiments, a stirring seat 134 is disposed inside the inner tub 131, and the outer peripheral surface of the stirring seat 134 presents a shape of a spiral rod.

Based on the above embodiments of the present application, the above structures further allow to prevent the possibility of clothes being entangled with each other, improve the cleanliness of the washing machine, and reduce the possibility of clothes being damaged.

The working principle of the washing machine according to the present application (the principle described below is only exemplary description, it does not mean that the washing machine according to this application can only be controlled in the following manner) is as follows:

1) Water inflow control: there is no need to count the time during the water inflow process; according to the selection of the water level gear, the encoder 330 sends a signal to the control circuit board 111, the control circuit board 111 feeds back the signal to the water level sensor 340, and the water level sensor 340 senses the amount of the water inflow through the air pressure of the pressure pipe, so as to control the water intake valve (or water injection pump, some water injection pumps may function as water valves when they stop working) to continuously allow water to enter, or not, and after a set water level is achieved, the water inflow is stopped;
2) Washing control: start to count the washing time (controlled by the program controller 220) after the water inflow is completed. That is, after a set water level is achieved, the motor works as required.
3) Drainage control: a drainage process begins after the washing process is completed, the drainage pump 113 is activated and other outputs are deactivated (the drainage time of the program controller 220 is not fixed, and after the program controller 220 detects an emptying (water level of 0), the software controls to continue to drain water for 60 seconds), and then follows a dehydration process;
4) Dehydration control

| Stages | | Remarks |
|---|---|---|
| 1 | (6 s ON-3 s OFF) *1 time, (6 s ON-15 s OFF) *4 times, (15 s ON-50 s OFF) *1 time, enter stage 2. If there is not enough time for the intermittent dehydration, go directly to stage 4. | Intermittent Dehydration |
| 2 | Carry out a continuous dehydration of 202 seconds, and then enter stage 3. If the remaining time is less than 202 seconds, enter stage 4. | Continuous Dehydration |
| 3 | Carry out the inertial dehydration according to the remaining time after the intermittent dehydration and the continuous dehydration. If there is no remaining time, skip the inertial dehydration and enter stage 4. | Inertial Dehydration |
| 4 | All electrical devices stop and the dehydration process ends. | Stop |

What is claimed is:

1. A stirring impeller type washing machine, comprising:

a washing machine body including a cabinet, a cover plate mounted on the cabinet, and a washing tub disposed within the cabinet, wherein a part of the washing tub is rotatable via a motor;

a washing assembly mounted on the cabinet or the cover plate, wherein the washing assembly includes a mode switch and a program controller which are connected to each other, the program controller has at least two switching positions, each of which corresponds to a working mode, and different rotation orientations of the mode switch correspond to different working modes of the stirring impeller type washing machine; and a water level assembly mounted on the cabinet or the cover plate, wherein the water level assembly includes a water level switch, a water injection controller, an encoder and a water level sensor, wherein both the water level switch and the water injection controller are connected to the encoder, the encoder is also connected to the water level sensor, the water level sensor faces towards an inner region of the washing tub, the encoder can directly or indirectly control the water injection controller to stop water injection after the water level sensor detects that a water level in the washing tub reaches a preset water level, wherein the water level switch can adjust the preset water level through different rotation orientations of the water level switch, wherein the washing tub includes an inner tub and an outer tub, and the inner tub and the outer tub are movably connected, the inner tub being capable of rotating within the outer tub, and the outer tub being suspended within the cabinet through at least three suspension rods; and a stirring seat is disposed inside the inner tub, and an outer peripheral surface of the stirring seat presents a shape of a spiral rod.

2. The stirring impeller type washing machine according to claim 1, wherein the cover plate comprises:

a face frame fixedly connected with the cabinet and covering an upper opening of the cabinet, wherein the face frame is provided with an entrance;

a control mounting plate fixedly connected with the face frame and arranged at one side of the entrance, wherein both the mode switch and the water level switch are mounted on the control mounting plate; and a door cover movably connected with the face frame and having a first position for closing the entrance and a second position for opening the entrance, wherein the door cover can be switched between the first position and the second position.

3. The stirring impeller type washing machine according to claim 2, wherein the control mounting plate is capable of cooperating with the face frame to form an accommodation chamber, and the program controller and the encoder are both mounted within the accommodation chamber;

a first bracket and a second bracket are provided on an inner wall of the accommodation chamber, the program controller is mounted on the first bracket, the encoder is mounted on the second bracket, a mode button is provided on and passed through the control mounting plate and is connected to the program controller such that rotation of the mode button is capable of causing the program controller to perform a corresponding start operation, and a water level button is provided on and passed through the control mounting plate and is connected to the encoder such that rotation of the water level button is capable of causing the encoder to perform a corresponding preset water level setting operation.

4. The stirring impeller type washing machine according to claim 1, wherein at least one of the water injection controller and the encoder is connected to the program controller, and after the water level in the washing tub reaches a preset water level, at least one of the water injection controller and the encoder activates the program controller to drive the stirring impeller type washing machine to work.

5. The stirring impeller type washing machine according to claim 1, wherein a connecting pipe and a tractor are provided at a bottom of the outer tub, the connecting pipe being connected with a drainage pump arranged on the cabinet, and the tractor being respectively connected to the drainage pump, the washing assembly and the water level assembly; and an outer ring is provided at a top of the outer tub, and the outer ring at least partially covers a region on top of the inner tub.

6. The stirring impeller type washing machine according to claim 1, wherein a control circuit board and a capacitor are arranged inside the cabinet, wherein the control circuit board is connected to the capacitor, and is further electrically connected to both the washing assembly and the water level assembly to control the washing assembly and the water level assembly to work.

7. The stirring impeller type washing machine according to claim 1, wherein the washing machine body further comprises a base fixedly connected at a bottom of the cabinet.

* * * * *